US010100626B2

(12) United States Patent
Martysevich et al.

(10) Patent No.: US 10,100,626 B2
(45) Date of Patent: Oct. 16, 2018

(54) METHOD OF STIMULATION OF BRITTLE ROCK USING A RAPID PRESSURE DROP

(71) Applicant: Halliburton Energy Services, Inc., Houston, TX (US)

(72) Inventors: Vladimir Nikolayevich Martysevich, Spring, TX (US); Jesse Clay Hampton, Conroe, TX (US); Cheng Chen, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/126,404

(22) PCT Filed: May 19, 2014

(86) PCT No.: PCT/US2014/038642
§ 371 (c)(1),
(2) Date: Sep. 15, 2016

(87) PCT Pub. No.: WO2015/178886
PCT Pub. Date: Nov. 26, 2015

(65) Prior Publication Data

US 2017/0081951 A1 Mar. 23, 2017

(51) Int. Cl.
*E21B 43/26* (2006.01)
*E21B 43/267* (2006.01)
*E21B 43/16* (2006.01)

(52) U.S. Cl.
CPC ..... *E21B 43/26* (2013.01); *E21B 43/164* (2013.01); *E21B 43/267* (2013.01)

(58) Field of Classification Search
None
See application file for complete search history.

(56) References Cited

U.S. PATENT DOCUMENTS

| | | | |
|---|---|---|---|
| 4,078,609 | A | 3/1978 | Pavlich |
| 8,127,850 | B2 | 3/2012 | Brannon et al. |
| 2008/0164030 | A1 | 7/2008 | Young |

(Continued)

FOREIGN PATENT DOCUMENTS

| | | | |
|---|---|---|---|
| EP | 0835983 | A2 | 4/1998 |
| EP | 2469020 | A1 | 6/2012 |

OTHER PUBLICATIONS

International Search Report and Written Opinion issued in PCT/US14/38642 dated Feb. 12, 2015, Halliburton Energy Services, Inc.

*Primary Examiner* — Angela M DiTrani
(74) *Attorney, Agent, or Firm* — McAfee & Taft

(57) ABSTRACT

A method and system for inducing secondary orthogonal fractures in an underground formation by introducing a proppant carrying fluid into a hydraulic fracture in an underground formation at high pressure is provided. The pressure of the proppant carrying fluid is lowered at a rate allowing the fluid to exit the formation while the proppant remains in place within the fractures. The pressure of the fluid is then rapidly reduced, creating fractures orthogonal to the surface of existing fractures by pushing remained proppant against hydraulic fractures walls. The orthogonal fractures can be opened with high pressure fluid and propped. In this way, the portion of the formation in fluid flow communication with the wellbore is increased.

15 Claims, 5 Drawing Sheets

(56) References Cited

U.S. PATENT DOCUMENTS

| | | | | |
|---|---|---|---|---|
| 2008/0183451 | A1* | 7/2008 | Weng | E21B 43/26 703/10 |
| 2009/0194273 | A1* | 8/2009 | Surjaatmadja | E21B 43/26 166/250.1 |
| 2013/0306315 | A1 | 11/2013 | Kaminsky et al. | |
| 2014/0262291 | A1* | 9/2014 | Chen | E21B 43/261 166/308.1 |
| 2014/0299318 | A1* | 10/2014 | Crews | E21B 43/267 166/280.2 |

* cited by examiner

METHOD OF STIMULATION OF BRITTLE ROCK USING A RAPID PRESSURE DROP

(1) FIELD OF THE INVENTION

The present method and system relates to hydraulic fracturing.

(2) BACKGROUND OF THE INVENTION

Conventional oil and gas drilling techniques produce economical quantities of hydrocarbons when performed on porous formations. Often when a wellbore penetrates a porous formation, oil and gas flow into the low pressure region created by the wellbore. However, less porous, or impermeable, formations containing hydrocarbons are typically inaccessible using conventional methods. Because oil and gas cannot easily flow through impermeable formations in economic quantities, such impermeable formations cannot usually be drilled economically using only conventional drilling techniques.

Methods of hydraulic fracturing developed in previous decades allow impermeable formations to produce oil and gas in economic quantities. Generally, hydraulic fracturing methods pump a fluid into a formation at a pressure sufficient to cause the formation to fracture, thereby creating primary fractures. The primary fractures in the formation increase the effective porosity of the formation and allow for the economic production of hydrocarbons. The primary fractures typically extend orthogonally outward from the wellbore.

Due to the comparative inability of oil and gas to flow through impermeable formations, usually only those portions of the formations close to the wellbore or the primary fractures are in fluid communication with the wellbore. Consequently, even with primary fractures, there can remain large portions of the formation, even relatively close to the wellbore, that are not in fluid communication with the wellbore.

BRIEF DESCRIPTION OF THE DRAWINGS

The drawings are provided to illustrate certain aspects of the invention and should not be used to limit the invention.

DETAILED DESCRIPTION OF EMBODIMENTS

Figure 1A:
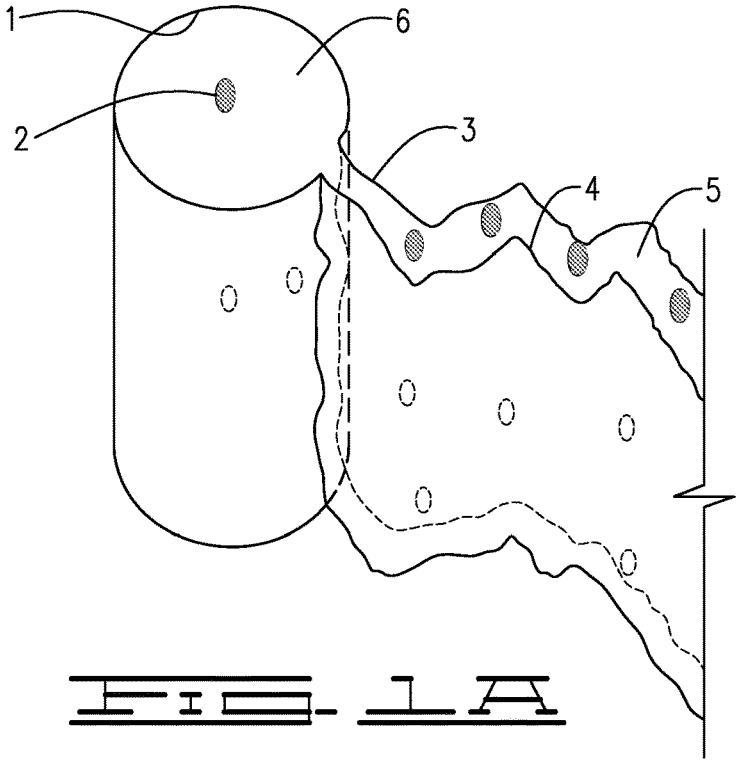
FIG. 1A-1F are a schematic illustrations depicting the steps of one embodiment of the method.

The current method and system relate to creating secondary, orthogonal fractures on the faces of existing primary fractures in an underground formation. Prior to applying the current method, the underground formation can contain fractures present either naturally or created using one or more hydraulic fracturing techniques. For example, the inventive method and system can be used in connection with brittle formations containing hydrocarbons.

Brittle rock tends to shatter or fracture when subjected to high pressures. Brittleness is not measured directly. Instead, brittleness is calculated from other characteristics of the rock in question. For example, elastic strain, dynamic Young's modulus, dynamic Poisson's ratio and porosity may all be used to calculate the brittleness of a formation. Because brittleness is not an intrinsic property of a formation, many methods exist to calculate brittleness. The methods proposed by Coates, Baron, Hucka and Das, Bishop, Hajiabdolma, Ingram, Rickman and Jarvie are among those known in the art as described in *Comparison of Brittleness Indices in Organic-rich Shale Formations* as presented in the 47$^{th}$ U.S. Rock Mechanics/Geomechanics Symposium in San Francisco, Calif. in 2013. The method proposed by Rickman calculates brittleness using the equation:

$$B = \frac{1}{2}\left(\frac{E_{dyn}(0.8-\emptyset)}{8-1} + \frac{v_{dyn}-0.4}{0.15-0.4}\right)100$$

Where B is the brittleness of the formation, $E_{dyn}$ is the dynamic Young's modulus, $v_{dyn}$ is the dynamic Poisson's ratio and Ø is the porosity.

If the brittleness of a formation is within a satisfactory range according to one or more of the above methods, the formation can be hydraulically fractured. Hydraulic fracturing creates a plurality of fractures in the formation. The formation can be hydraulically fractured using any suitable method. When completed, the fractured formation comprises a wellbore and a plurality of fractures extending outward from the wellbore. The formation is then ready for treatment using the present method and system. Although in many instances hydraulic fracturing can be used to achieve a suitable fracture formation, it should be understood that hydraulic fracturing is not necessary for use of the current method and system where a formation already has suitable fractures, either naturally occurring on introduced by other techniques. Also, while the above discussion relates to brittle formations, the current method and system may also be applied to other suitable formations.

Below, the terms "trapping rate," "secondary fracturing rate" and "orthogonal fractures" are used. As further described below with reference to FIGS. 1 and 2, the "trapping rate" relates to the flow back of the first fluid which directs the first fluid 6 from the fracture to the wellbore. The pressure of the fluid is reduced at the trapping rate after the system has been provided with the first proppant and during which the proppant is secured in place between the first surface and second surface of the fracture. As discussed, the trapping rate should usually be low enough that the first fluid exits the formation but typically not so high that the first proppant substantially exits the fractured formation or the plurality of fractures.

In addition to the trapping rate, the present method and system utilize a "secondary fracturing rate," which also refers to fluid flow from fracture to wellbore. Unlike the trapping rate, the secondary fracturing rate should usually be as rapid as possible. The secondary fracturing rate should typically be high enough to cause the faces of the existing hydraulic fractures to crack around the points at which they contact the first proppant. Generally, the rate of pressure decrease employed during the fracture rate will be greater than the rate of pressure decrease employed during the trapping rate.

Figure 1B:
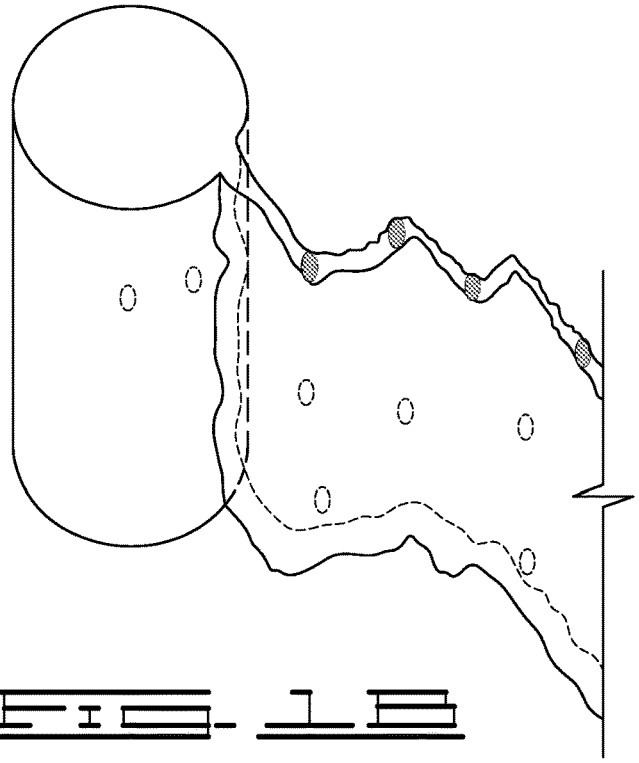
Figure 1C:
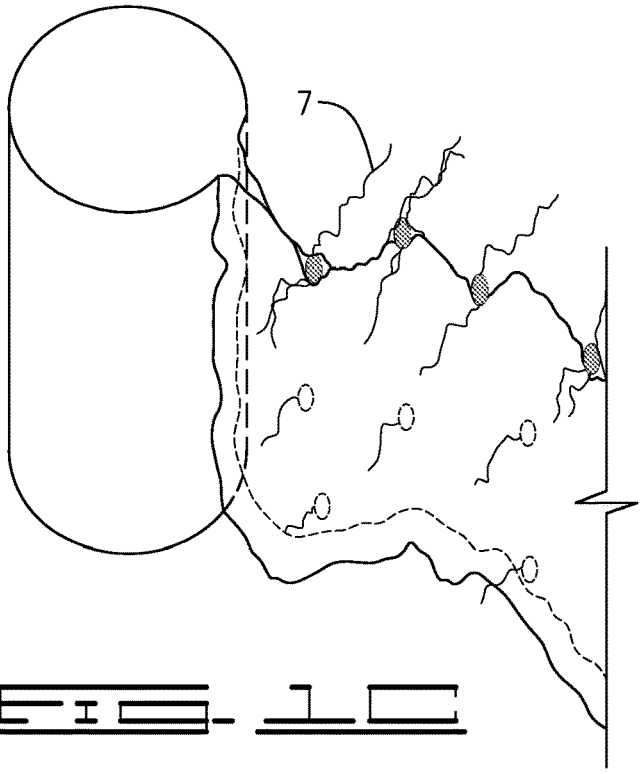

Secondary orthogonal fractures or just orthogonal fractures, as illustrated as fractures 7 in FIG. 1C, are the fractures created on the faces of the existing plurality of primary hydraulic fractures, as illustrated as fractures 5 in FIG. 1A, in a fractured formation as a result of the method and system described in the present application. The secondary orthogonal fractures will generally run orthogonal or perpendicular to the primary hydraulic fractures and perpendicular to the direction of the least in-situ formation stress. The in-situ stress of the formation can have a number of directional components. The primary directional component of stress in the formation will usually be downward from the surface, due to the weight of the overlying rock. As such, the secondary orthogonal fractures will typically be perpendicular or orthogonal to the surface and perpendicular or orthogonal to the primary hydraulic fractures. Further, the in-situ stress of the formation can also vary in other directions with respect to the wellbore. Generally, there will also be a direction in which the horizontal in-situ stress will be greatest and a direction in which the horizontal in-situ stress will be lowest.

Figure 1D:
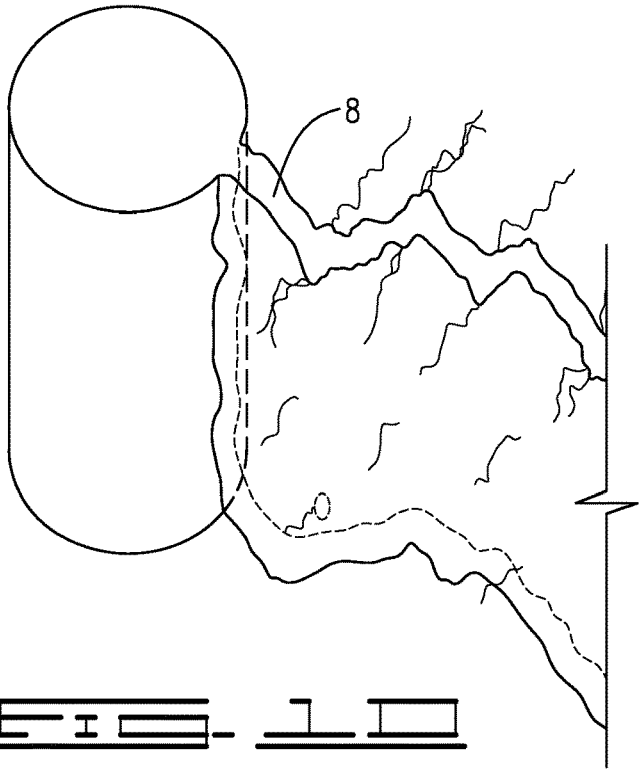
Figure 1E:
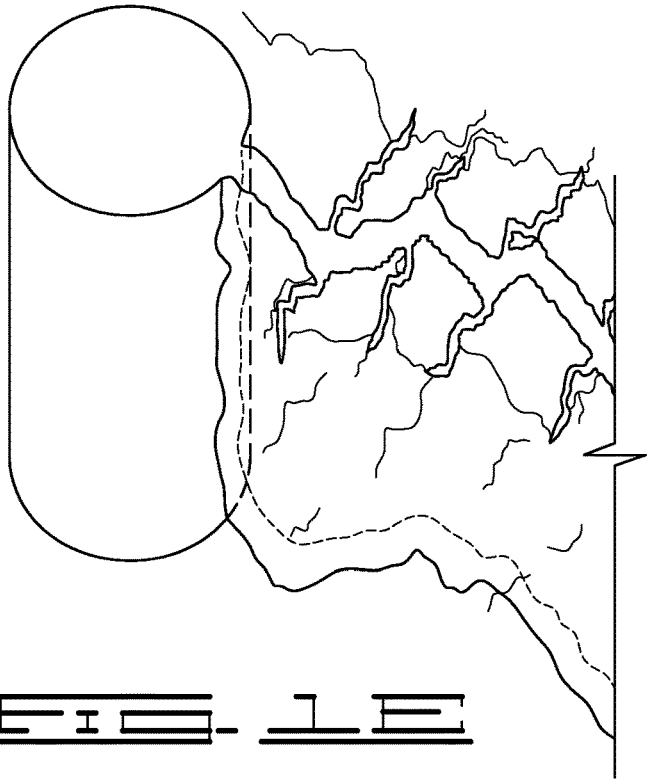
Figure 1F:
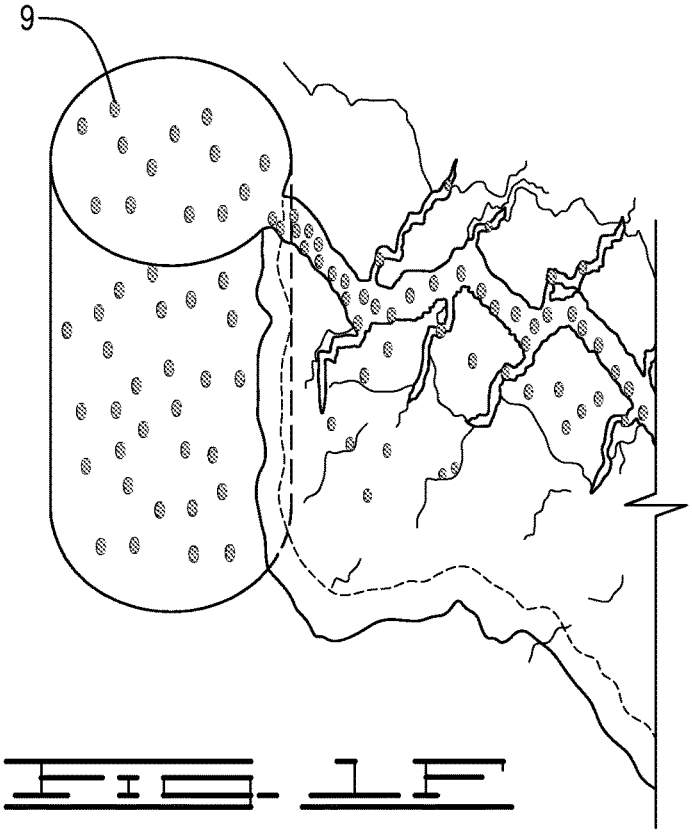
Figure 2:
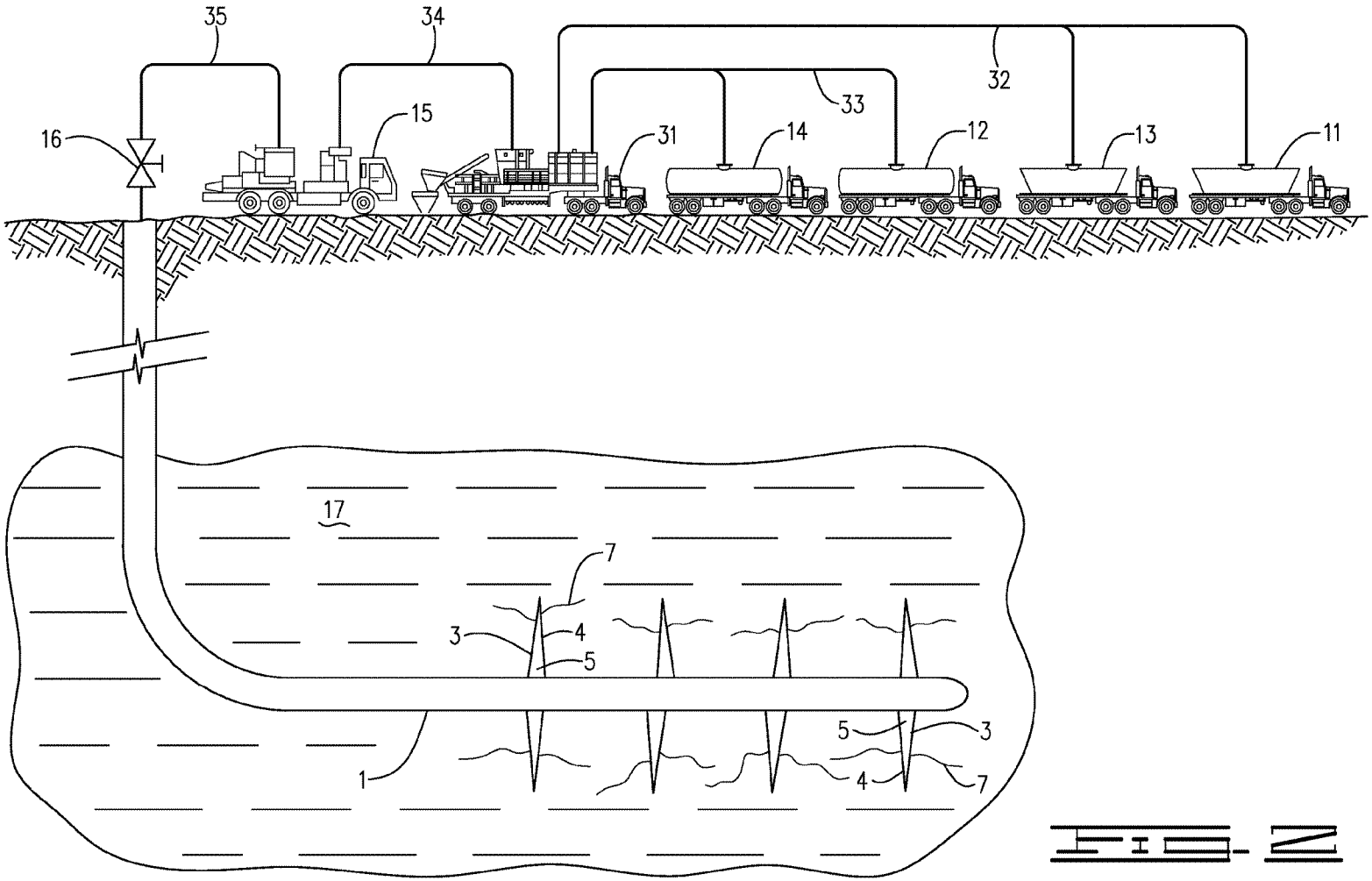
FIG. 2 is a schematic illustration depicting a system configured to perform the method described herein.

Referring generally to FIGS. 1 and 2, the present method and system pump a first fluid 6 carrying the first proppant 2 into a fractured formation 17. After the first proppant 2 has been carried by the first fluid 6 into the plurality of fractures 5, the pressure of the first fluid 6 in the fractured formation 17 is reduced at a trapping rate. As discussed, the trapping rate should typically be such that the first fluid 6 leaves the system while the first proppant 2 remains in place, secured or trapped in the existing fractures 5.

Once the first proppant 2 is substantially secured in place, the pressure of the first fluid 6 is allowed or caused to drop rapidly at a secondary fracturing rate. As the pressure of the fluid in the formation drops at the secondary fracturing rate, the faces of the existing fractures will generally exert pressure on the first proppant 2. As a result, the first proppant 2 will create secondary orthogonal fractures 7 in the plurality of fractures 5 already present in the fractured formation 17 and extend the area of the formation in fluid flow communication with the wellbore Enough first fluid 6 at a high enough pressure should typically be used to pressurize the fractured formation 17 despite fluid loss that may occur into the fractured formation 17. The first fluid 6 can be any fluid suitable for introducing a proppant into a fractured formation 17. The first fluid 6 will usually have a low viscosity.

The first fluid 6 will introduce the first proppant 2 into the fractured formation 17. The first proppant can have a large size and high strength. Once the proppant carrying first fluid 6 has sufficiently entered the plurality of fractures 5 such that the first proppant 2 has obtained a desired concentration within the plurality of fractures 5, the pressure of the first fluid can be allowed or caused to decrease at the trapping rate. The concentration of the first proppant will preferably create no more than a monolayer of proppant in the plurality of fractures. More preferably, the first proppant 2 will exist as a rarefied monolayer on the first surface 3 and second surface 4 of the plurality of fractures 5. A rarefied monolayer exists where the concentration of the proppants on the first and second surfaces of the plurality of fractures 5 is low enough such that the distance between individual proppant grains greatly exceeds the size of the grains themselves.

The distance between individual proppant grains on the first and second surfaces of the plurality of fractures 5 can be much greater than the diameter of the individual proppant grains. More preferably, the distance between proppant grains should be from about 10 to about 100 times the size of the individual proppant grains. Most preferably, the distance between proppant grains should be from about 100 to about 1000 times the diameter of the individual proppant grains. Situated this way, the proppant can cause the maximum concentration of stress in the formation as the first and second surfaces of the plurality of fractures close around the first proppant 2.

Referring now to FIG. 1A, the fractured formation 17 has already been fractured using one or more hydraulic fracturing techniques or contains fractures present naturally. Fracturing techniques vary greatly, but typically involve pumping a fluid into a formation at a pressure sufficient to cause fractures in the formation. The fluid might be mixed with a proppant and additional chemicals. The hydraulic fracturing should result in a plurality of fractures 5 extending out from the wellbore 1.

The first fluid 6 carrying the first proppant 2 is pumped into the existing hydraulically fractured formation 17 at a first pressure. The first pressure should be sufficient to separate the first inner surface 3 and the second inner surface 4 of the plurality of fractures 5 such that the first proppant 2 can substantially penetrate the plurality of fractures 5. The first pressure should be at least equal to the in-situ stress of the formation 17 plus sufficient additional pressure to create fractures, but the first pressure should not exceed the maximum horizontal in-situ stress value. More specifically, the first pressure of the fluid can be in the range of about 5,000 psi to about 20,000 psi. More preferably, the first pressure of the first fluid 6 can be in the range of from 7,500 to 17,500. Most preferably, the first pressure of the first fluid 6 can be in the range of from 10,000 to 15,000. The first pressure and all other pressures refer to the bottom hole treating pressure.

Further, the first fluid 6 must be appropriately viscous. The viscosity of the first fluid 6 will typically be high enough to allow it to open the existing plurality of hydraulic fractures 7, but low enough to allow it to exit the formation easily when the pressure of the first fluid 6 is reduced. Fluid viscosity can be selected based on the volume of the fractures in the formation 17 and the specific formation conditions in the formation 17 such as: horizontal stress, formation pressure, formation permeability and other factors. As such, the appropriate viscosity of the first fluid 6 will vary greatly depending on formation. For example, viscosities in the range of from about 1 to 10,000 centipoise may be appropriate.

Further, the first fluid 6 can be any suitable fluid for use with hydraulic fracturing. Preferably, the first fluid 6 will comprise fluids such as nitrogen or carbon dioxide. The first fluid 6 can also contain additives that improve the performance of the first fluid 6. Potential additives can include acids, anti-bacterial agents, breakers, clay stabilizers, corrosion inhibitors, cross linkers, friction reducers, gelling agents, iron controls, pH adjusting agents, scale inhibitors and surfactants.

In addition to opening up the plurality of fractures 5, a purpose of the first fluid 6 is to introduce the first proppant 2 into the plurality of fractures 5. The first proppant material should usually have a higher strength than the formation material and be compatible with the fracturing fluid. The first proppant 2 should typically be larger and have greater compressive strength than traditional proppants. The first proppant 2 should usually be of sufficient strength to resist shattering or deformation when the pressure of the formation is transmitted through the first surface 3 and second surface 4 to the proppant. The first proppant 2 should usually be of a large enough size to provide an effective wedge around which the formation can fracture or crack and is typically as close to spherical in shape as possible. However, the first proppant must be small enough to enter the interior of the existing hydraulic fractures at a desired concentration.

The strength of the proppant can be in the range of from 10,000 psi closure stress rating, also called intermediate strength, to 20,000 psi closure stress rating, also called ultra high strength. More preferably, the strength of the first proppant 2 can be in the range of from 15,000 to 20,000 psi closure stress rating. Most preferably, the compressive strength of the first proppant 2 can be in the range of from 15,000 to 17,000 psi closure stress rating. The closure stress rating refers to the stress that the formation exerts on the proppant. That is, if the closure stress rating of the formation is 10,000 psi, the proppant must usually be able to withstand at least 10,000 psi in order to function. Generally, the proppant will also need to be able to impart additional pressure in order to create fractures in the formation 17.

A large size will usually allow the first proppant 2 to provide an effective surface around which the first and second surfaces of the hydraulic fractures 7 can further fracture. The first proppant 2 can have an average size in the range of from about 60 to about 4 mesh. More preferably, the first proppant 2 can have size in the range of from 40 to 4. Most preferably, the first proppant 2 can have size in the range of from 20 to 4 mesh.

Additionally, the first proppant 2 can comprise any material suitable for use with the proposed method and system. For example, coated and uncoated sand, resin, ceramics and bauxite can be used. However, some materials may be incapable of withstanding the localized pressure required by the invention without deforming or being crushed by the first and second surfaces of the plurality of fractures 5. For example, walnut shells will typically be unsuitable for use as a proppant with the present method and system. Preferably, the first proppant 2 comprises high strength bauxite.

The concentration of the first proppant 2 in the first fluid 6 should not be too high. If too much first proppant 2 enters the existing fractures and contacts the first and second surfaces of the fracture, the proppant may effectively distribute the pressure exerted by the formation and therefore the stress needed to further fracture the first and second surfaces of the plurality of fractures 5 will not be present at any given point. As a result, a high density of proppant particles could reduce the ability of the first proppant 2 to create orthogonal fractures in the first and second surfaces of the fracture. Additionally, too high a concentration of proppant can result in stacking of the proppant within the formation, such that not all of the proppant contacts a surface of the fracture.

First proppant 2 that does not ultimately contact the surface of a fracture could be wasted. Thus, the concentration of the first proppant 2 is typically such that it is well dispersed in the existing fractures and, preferably, is such that not more than a monolayer of first proppant is trapped between the first surface 3 and second surface 4. Stated another way, when the first surface 3 and second surface 4 close around the proppant, there should not usually be more than a single layer of first proppant 2. It is typically desirable for the first proppant to exist as a rarefied monolayer on the first and second surfaces of the plurality of fractures. A rarefied monolayer exists where the concentration of the proppants on the first and second surfaces of the plurality of fractures 5 is low enough such that the distance between individual proppant grains greatly exceeds the size of the grains themselves. Therefore, it can be desirable to maintain the concentration of the first proppant from about 0.05 $lb/ft^2$ to about 0.45 $lb/ft^2$. More preferably, the concentration of the first proppant can be from about 0.07 $lb/ft^2$ to about 0.42 $lb/ft^2$. Most preferably, the concentration of the first proppant can be from about 0.1 $lb/ft^2$ to about 0.4 $lb/ft^2$ depending on proppant density and number of cracks or fractures created.

Referring to FIG. 1B, once the formation contains sufficient first fluid 6 and first proppant 2 such that the first proppant has been carried into the plurality of fractures 5 at a desired concentration, the pressure of the first fluid 6 is typically reduced at the trapping rate. The trapping rate should be such that the low viscosity first fluid 6 easily exits the formation while the first proppant 2 remains substantially in place inside the plurality of fractures 5 within the fractured formation 17. As a result, the hydrostatic pressure in the formation is reduced such that the first inner surface 3 and the second inner surface 4 close around and contact the first proppant 2 thus securing a substantial portion of the proppant in place within the plurality of fractures 5.

While some of the first proppant 2 will usually exit the plurality of fractures 5 as the pressure of the first fluid 6 decreases at the trapping rate, it is a goal to maintain as much of the first proppant 2 in the plurality of fractures in the formation as possible. It is desirable that a majority of the proppant is secured in the plurality of fractures 5. More preferably, greater than 75% of the proppant introduced into the system becomes secured in the fractures. Most preferably, greater than 90% of the proppant introduced into the system becomes secured in the fractures.

The trapping rate can be kept constant or adjusted. The trapping rate can be reduced in a variety of ways. For example, a valve can be adjusted to keep the trapping rate constant. Similarly, a valve can be adjusted to cause the trapping rate to increase or decrease. Generally, it is desirable for the trapping rate to be from about 0.1 to about 3 barrels per minute. More preferably, the trapping rate can be from 0.5 to 2 barrels per minute. Most preferably, the trapping rate can be from 0.5 to 1 barrel per minute, depending on current leak-off and treating pressure conditions.

It is currently believed, that lowering the pressure of the first fluid 6 at the trapping rate causes the first surface 3 and second surface 4 of the plurality of fractures 5 to close around the first proppant 2. Accordingly, when the pressure of the first fluid 6 is reduced sufficiently, the first and second surfaces of the plurality of fractures 5 contact and exert pressure on the first proppant 2, thus securing the first proppant 2 within the plurality of fractures 5. As the first and second surfaces of the fractures close around the first proppant 2, the rate of pressure change in the fractured formation 17 and the first fluid 6 can change. For example, assume the trapping rate begins at 5 psig per second and declines at a rate of 0.1 psig per second every second. Once the formation begins to exert pressure on the proppant, the rate of change of the pressure decrease might change to 0.01 psig per second every second, indicating the surfaces of the fractures inside the formation have started to contact and exert pressure on the proppant.

Stated differently, the trapping rate is the derivative of the fluid pressure with respect to time. Therefore, the rate of change of the trapping rate is the second derivative of fluid pressure with respect to time in the formation. From this perspective, the plurality of fractures 5 exerting pressure on the first proppant 2 can produce a significant change in at least the second derivative of fluid pressure. A significant change in the first or second derivatives of fluid pressure usually indicates that the fractured formation 17 has begun to exert pressure on the first proppant 2 and is ready for the next step in the invention. Of course, it is unlikely the first or second derivatives of fluid pressure in the formation will remain constant; variation and noise are expected. Nevertheless, the exertion of pressure on the proppant by the plurality of fractures 5 as the pressure of the first fluid 6 decreases at the trapping rate typically will produce a change in the behavior of the first or second derivatives of fluid pressure in the formation.

Referring to FIG. 1C, when the pressure in the fractured formation 17 has reached a desired pressure or the trapping rate has declined to a desired rate, the pressure of the first fluid 6 is allowed to decrease as fast as is possible at the secondary fracturing rate. Because the first inner surface 3 and second inner surface 4 contact the first proppant 2, the pressure of the first fluid 6 in the formation can be reduced rapidly without removing the first proppant 2 from the system and thus create orthogonal fractures 7. While not wishing to be bound by theory, it is currently believed that the rapid decrease in the pressure of the first fluid 6 causes the rapid closing of the first inner surface 3 and second inner surface 4 around the first proppant 2; hence, causing the first inner surface 3 and second inner surface 4 to crack or fracture around the first proppant 2. It is believed that his cracking or fracturing creates orthogonal fractures 7 in the surfaces of the first inner surface 3 and the second inner surface 4 of the plurality of fractures 5.

Commonly, the pressure of the first fluid 6 or the fractured formation 17 is monitored graphically. That is, the pressure is viewed in a two dimensional plot of pressure against time. The trapping rate can be maintained as long as the pressure of the formation is assisting the hydrostatic pressure of the fluid in causing the first fluid 6 to exit the formation. Once the first and second surfaces contact the first proppant 2, the primary driving force causing the first fluid 6 to exit the formation will be hydrostatic pressure. This will typically appear as a leveling off, or decline in the rate of decline of the pressure of the first fluid 6 or the formation.

The rapid release of the first fluid 6 or the rapid decrease in the pressure of the fluid at the secondary fracturing rate can be accomplished in a variety of ways. For example, if the pressure of the first fluid 6 in the fractured formation 17 is controlled by a valve, the valve might be completely opened. Additionally, a pump could provide suction to the fractured formation 17.

As the first and second surfaces of the plurality of fractures 5 close around the first proppant 2, the proppant grains are exposed to concentrated horizontal stress. As a result of the rapid pressure decrease at the secondary fracturing rate, the first and second faces of the existing hydraulic fractures will crack or fracture around the large, hard first proppant 2. Due to the fairly round shape of proppant grains the area of contact between the grain and fracture face is small. Additionally, the relatively low concentration of proppant in the formation does not usually prevent fracture faces from moving toward each other. These factors will typically lead to high stress concentration around where the proppant and formation contact. As a result, secondary orthogonal fractures 7 are created on the first and second surfaces of the plurality of fractures 5 within the fractured formation.

The particular pressure or rate of pressure decrease at which the secondary fracturing rate is initiated will typically vary greatly depending on, among other things, the characteristics of the fractured formation 17. Generally speaking, the secondary fracturing rate will be initiated when the trapping rate begins to level off, or the rate of pressure decrease in the formation decreases significantly. One indication of when the formation is ready to initiate the secondary fracturing rate is the rate at which the first fluid 6 flows back out of the formation.

The secondary fracturing rate can be initiated once the flow back out of the system reaches between about 2 barrels per minute to about 1,000 barrels per minute. More preferably, the secondary fracturing rate can be initiated from 2 to 250 barrels per minute. Most preferably, the secondary fracturing rate can be initiated from 2 to 100 barrels per minute.

One purpose of initiating the secondary fracturing rate is to create orthogonal fractures 7 in the formation 17. The extent to which orthogonal fractures 7 are created is typically a function of both the overall pressure in the fractured formation 17 and the rate of change of pressure in the fractured formation 17. When the pressurized first fluid 6 is removed from the fractured formation 17, the fractured formation 17 exerts pressure on the first proppant 2 within the fractures 5. More secondary orthogonal fractures 7 having greater size can form in response to greater pressures in the fractured formation. Similarly, more secondary orthogonal fractures 7 having greater size can form depending on the rate at which pressure changes within the fractured formation 17. Generally, a more rapid pressure change in the system will result in more and larger orthogonal fractures 7. Rapid changes in pressure can be accomplished by causing the pressurized first fluid 6 to exit the fractured formation 17 as rapidly possible. Additionally, suction can be provided to the fractured formation 17 to increase the rate at which pressure drops within the fractured formation 17.

Referring to FIG. 1D, once the orthogonal fractures 7 have been created, further steps can be used to open and prop the created orthogonal fractures 7. For example, a second fluid 8 can be introduced into the fractured formation at a second pressure. The second pressure and the viscosity of the second fluid 8 should be sufficient to allow the second fluid 8 to reopen the first inner surface 3 and second inner surface 4 of the plurality of fractures 5. The second fluid 8 is typically be pumped with sufficient pressure to open up the closed fractures. Pressure and viscosity ranges of second fluid will depend on specific well and formation conditions.

The pressure of the second fluid is typically the same as the pressure of first fluid. More specifically, the second pressure of the second fluid 8 can be in the range of about 5,000 psi to about 20,000 psi. More preferably, the first pressure of the first fluid 6 can be in the range of from 7,500 to 17,500. Most preferably, the first pressure of the first fluid 6 can be in the range of from 10,000 to 15,000. The first pressure and all other pressures refer to the bottom hole treating pressure. Additionally, the second fluid 8 can be any fluid suitable for the described method and system.

Referring to FIG. 1E, once the second fluid 8 has opened the closed fractures, the pressure of the second fluid 8 is increased to a third pressure in order to cause the second fluid 8 to open the orthogonal fractures 7 created in the first inner surface 3 and second inner surface 4. The third pressure should be sufficient to cause the orthogonal fractures 7 to open in addition to the plurality of fractures 5 in the fractured formation 17. The second fluid is preferably free of proppants while it is being used to open up the orthogonal fractures 7. The third pressure of the second fluid 8 should be equal or higher than maximum horizontal in-situ stress value.

Referring to FIG. 1F, once the second fluid 8 has opened the plurality of fractures 5 and the orthogonal fractures 7, a third fluid carrying the second proppant 9 can be pumped into the fractured formation 17 in order to prop open the orthogonal fractures 7. The third fluid can be the same or different from the first and second fluids. The second proppant 9 can be the same or different than the first proppant 2. Typically, the second proppant 9 introduced at this stage can be smaller and softer than the first proppant 2. A purpose of introducing the second proppant 9 is to prop the created orthogonal fractures 7 open as much as possible.

The third fluid can be pumped into the formation carrying the second proppant 9 at a fourth pressure. The fourth pressure can be higher than the third pressure. The third fluid can be the same or different than the first fluid 6 or the second fluid 8. Fluid viscosity can be selected based on the volume of the fractures in the formation 17 and the specific formation conditions in the formation 17 such as: horizontal stress, formation pressure, formation permeability and other factors. As such, the appropriate viscosity of the third fluid can vary greatly depending on formation. For example, viscosities in the range of from about 1 to 10,000 centipoise may be appropriate.

The second proppant can be any proppant suitable for propping a fractured formation. The second proppant 9 can be smaller than the first proppant 2. The average size of the second proppant 9 can be in the range of from 200 to 10 mesh. More preferably, the average diameter of the second proppant 9 can be in the range of from 150 to 10 mesh. Most preferably, the average diameter of the second proppant 9 can be in the range of from 120 to 10 mesh. The size and type of the second proppant can be selected based on formation conditions and should be designed to maximize the value of horizontal stress within the formation and should also be designed with the type and viscosity of the fluids used during hydraulic fracturing in mind.

Additionally, a higher concentration of the second proppant 9 can be used than was desirable for the first proppant 2. The concentration of the second proppant can be selected based on several factors including the volume of the created fractures, the specific formation characteristics and the anticipated characteristics of the formation during hydraulic fracturing stimulation or during well production. More specifically, the concentration of the second proppant 9 can be in the range of from 1 to 15 ppg, or pounds per gallon of the fluid carrying the second proppant 9. More preferably, the concentration of the second proppant can be in the range of from 1.5 to 10 ppg. Most preferably, the concentration of the second proppant can be in the range of from 2 to 7.5 ppg. Additionally, the second proppant 9 does not need to be as strong as the first proppant 2. Note that the method of creating secondary orthogonal fractures in a system of existing hydraulic fractures can be repeated, thereby creating tertiary orthogonal fractures on the surface of the secondary orthogonal fractures.

Referring to FIG. 2, there is displayed a system adapted to perform the earlier described method. The system is adapted to introduce a system of orthogonal fractures 7 into an existing fractured formation 17. The first proppant supply 11 containing the first proppant 2 is connected by a first series of pipes 32 to a blending device 31. The second proppant supply 13 containing the second proppant 9 is connected by a series of pipes 32 to the blending device 31. Similarly, the first fluid supply 12 and the second fluid supply 14, containing the first and second fluid, respectively, are also connected to the blending device 31 by a second series of pipes 33. The connections between the first proppant supply 11, the second proppant supply 13, the first fluid supply 12 and the second fluid supply 14 and the blending device 31 are generally at low pressure. The blending device 31 mixes the appropriate fluids and proppants in the desired ratio. Generally, the first and second proppant supplies, the first and second fluid supplies and the blending device may, but are not required to, be in the form of properly adapted trucks. Further, the first and second series of pipes may be any suitable device for transferring a proppant or a fluid.

Once the blending device 31 has mixed the first or second proppant with the first or second fluid, a third series of pipes 34 delivers the fluid and proppant mixture to a pumping device 15. The pumping device may, but is not required to, be in the form of a properly adapted truck. The pumping device 15 increases the pressure of the first or second fluid to the different pressures required by the present invention. The pumping device 15 delivers the first or second fluid through a fourth series of pipes 35 to a valve or series of valves 16 that control the entrance and exit of the first or second fluid from the wellbore 1. The pumping device 15 controls the entry of the first fluid 6, the first proppant 2, the second fluid 8 and the second proppant 9 into the wellbore 1 and from there the fractured formation 17. The pumping device 15 is generally able to control the flow rates and pressures with which each of the proppants and fluids enters the fractured formation 17 along with the valve 16. As before, the third and fourth series of pipes may be any suitable device for transferring a proppant or a fluid. It will also be apparent to those skilled in the art that the system can be adapted to include a third proppant supply with a third proppant, a third fluid supply with a third fluid, etc. Further, the pumping device 15 and valve 16 can be of any suitable type able to perform the functions described when discussing FIG. 1.

Figure 3:
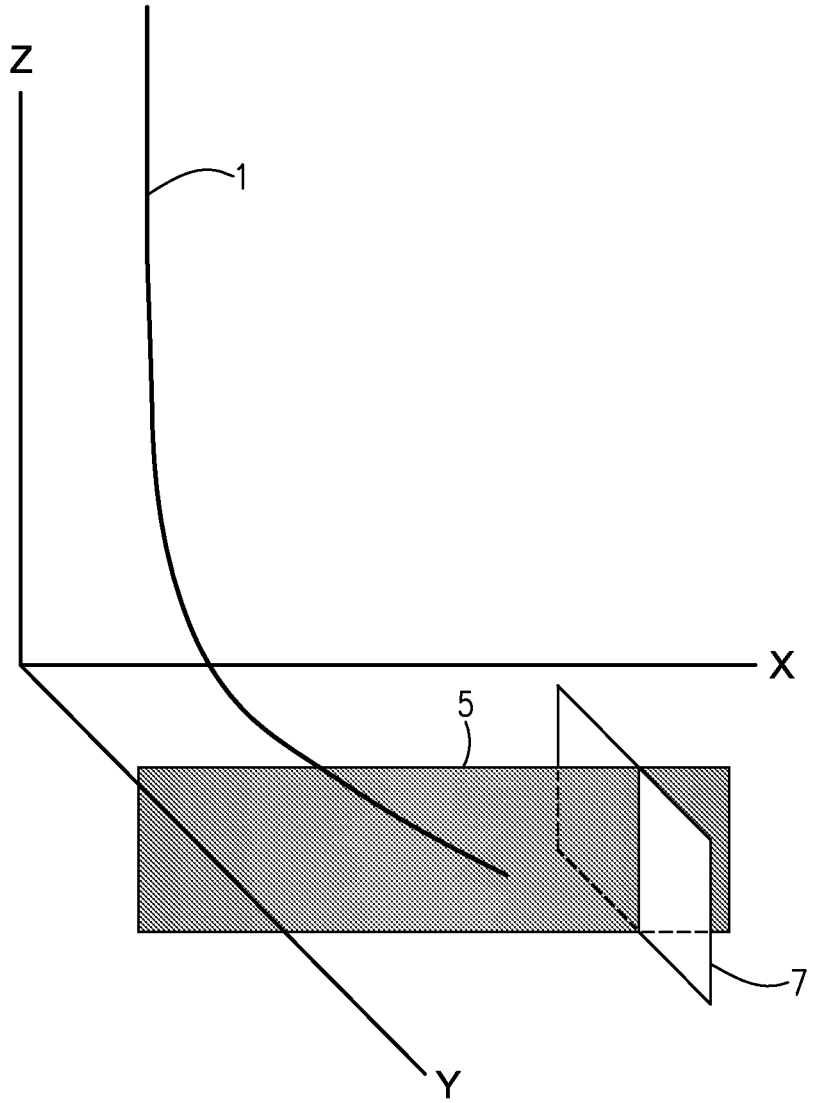
FIG. 3 is an illustration depicting the three dimensional orientation of primary fractures, secondary orthogonal fractures, the wellbore and the surface.

Referring to FIG. 3, the geometry of the fractured formation 17, the plurality of fractures 5 and the plurality of fractures are more accurately displayed. In FIG. 3, the wellbore 1 extends downward from the surface. Due to having been hydraulically fractured, the wellbore contains a plurality of fractures 5 that extend parallel to the X-Z plane. Extending outward from the plurality of fractures are the induced secondary fractures 7. The secondary fractures 7 extend outward perpendicular or orthogonal to the plurality of fractures 5. Both the plurality of fractures 5 and the induced secondary fractures 7 are perpendicular to the surface. In FIG. 3, the surface is parallel to the X-Y plane.

The orientation of the plurality of fractures 5 and the secondary fractures is determined largely by the orientation of stress within the formation. Generally, fractures will form perpendicular to the plane of greatest stress. For example, the plane of greatest stress is generally the X-Y plane pushing downward from the surface as a result of the weight of the formation. Therefore, the primary fractures 5 will tend to spread outward from the wellbore 5 perpendicular or orthogonal to the surface. Further, when the secondary fractures 7 are created, they tend to spread outward from the primary fractures 5 and perpendicular to the surface. Although FIG. 3 provides an example of how the geometry of the wellbore, the primary fractures 5 and the secondary, orthogonal fractures 7 will relate to one another, the particular geometry of these elements can vary.

Example of the Present Method and System

To determine the efficacy of the present method and system, a trial was performed. Two shale cores were obtained. The first proppant was placed between the two shale cores. The space between the two shale cores simulated one of the plurality of fractures 5. The shale cores simulated the fractured formation 17. Mechanical loading was applied to the shale cores around the first proppant 2 in order to simulate the secondary fracturing rate. Two dimensional slices in the fracture and shale matrix were obtained by CT scanning. The effect of the first proppant on the shale cores at different pressure was observed. At 0 psig, natural fractures in the face of the existing hydraulic fracture were observable, but the first proppant did not appear to create secondary orthogonal fractures in the formation. At 1000 psig, the first proppant expanded existing fractures in the formation. At 3000 psig, the first proppant created and expanded numerous secondary, orthogonal fractures in the formation.

The above results indicate the effectiveness of the present method and system. First, they demonstrate that a properly selected proppant will resist being crushed by the first and second surfaces of the plurality of fractures, even when subjected to high pressures. Additionally, they demonstrate that orthogonal fractures can be created in shale rock as a result of pressure being applied to a proppant. As such, the results demonstrate the effectiveness of the present method and system.

There are a number of satisfactory arrangements of the above elements that will be apparent to those having skill in the art. For example, the first and second fluid supplies and the first and second proppant supplies can be arranged in series or in parallel and can be connected to multiple pumping devices and controlled by multiple valves. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

The invention claimed is:

1. A method of hydraulic fracturing comprising:

(a) pumping a first fluid at a first pressure into a fractured formation having a plurality of fractures where each of said plurality of fractures has a first inner surface and a second inner surface, and where said fiat fluid contains a first proppant;

(b) reducing the pressure of said first fluid in said plurality of fractures at a trapping rate: such that said first fluid flows back out of said formation while said formation retains said first proppant in said fractures as a result of pressure transmitted from said first and second inner surfaces to said proppant, and wherein, said first fluid contains said first proppant at a concentration not to exceed the amount required to create a rarefied monolayer between said first inner surface and said second inner surface;

(c) further reducing the pressure of said first fluid in said formation at a secondary fracturing rate greater than said trapping rate such that said first proppant creates orthogonal fractures in said first and second inner surfaces as said first and second inner surfaces fracture around said proppant and (d) pumping one or more secondary fluids and a second proppant into said fractured formation such that said orthogonal fractures open and said second proppant is introduced into said orthogonal fractures.

2. The method of claim 1 wherein step (d) comprises:

(i) pumping a second fluid into said fractured formation at a second pressure such that said plurality of first and second inner surfaces in said formation reopen;

(ii) increasing the pressure of said second fluid pumping into said formation from a second pressure to a third pressure such that said orthogonal fractures created by said first proppant open:

iii) pumping a third fluid containing the second proppant into said fractured formation at a fourth pressure such that said second proppant enters said orthogonal fractures.

3. The method of claim 2, wherein prior to step (a) a formation is hydraulically fractured in order to create said fractured formation having said plurality of fractures with said first inner surface and said second surface.

4. The method of claim 3 wherein said fourth pressure is higher than the maximum horizontal in-situ stress of said formation and said first pressure is higher than the minimum horizontal in-situ stress of said formation.

5. The method of claim 1 wherein the pressure in step (b) is initially reduced at said trapping rate such that said first fluid flows on of said formation at a rate of from about 0.5 to about 1 barrel per minute.

6. The method of claim 5 wherein, once said trapping rate decreases below the minimum horizontal in-situ stress, step (c) is carried out at said secondary fracturing rate, where said secondary fracturing rate is performed at a rate sufficient to create said orthogonal fractures in said first and second inner surfaces of said plurality of fractures.

7. The method of claim 1 wherein said first proppant has a greater strength than said second proppant.

8. The method of claim 1, wherein said first fluid has a lower viscosity than said second fluid such that the viscosity of said first fluid does not cause said first proppant to exit said formation in step (b) and said second fluid is able to cause said orthogonal fractures to open it step (d).

9. The method of claim 1 wherein said first fluid comprises one of nitrogen or carbon dioxide.

10. The method of claim 1 wherein the concentration of said first proppant in said first fluid is such to create proppant distribution in said fracture of from about 0.1 $lb/ft^2$ to about 0.4 $lb/ft^2$ and the concentration of said second proppant in said second fluid is in the range of from to 1to 15 ppg.

11. The method of claim 1 wherein the size of said first proppant is in the range of from 60 to 4 mesh and the size of said second proppant is in the range of from 200 to 10.

12. A system for hydraulic fracturing comprising:

(a)a fractured formation;

(b) a first proppant supply containing a first proppant;

(c) second proppant supply containing a second proppant;

(d) a first fluid supply containing a first laid;

(e) a second fluid supply containing a second fluid;

(f) a blending device adapted to connect to said first and second fluid supplies and said first arid second proppant supplies;

(g) a pumping device adapted to connect to said blending device and to a wellbore and further adapted to deliver said first proppant contained in said first proppant supply, said second proppant contained in said second proppant supply, said first fluid contained in said first fluid supply and said second fluid contained in said second fluid supply into said wellbore and into said fractured formation;

(h) a valve located bet between said pumping device and said wellbore adapted to control the delivery of said first and second fluids and said first and second proppants into and out of said wellbore;

wherein the system is configured to:

(i) pump said first fluid containing said first proppant at a first pressure into a fractured formation having a plurality of fractures where each of said plurality of fractures has first inner surface and a second inner surface;

(ii) reduce the pressure of said first fluid in said formation at a trapping rate such that said first fluid flows back out of said formation while said formation retains said first proppant in said fractures as a result of pressure transmitted from said first and second inner surfaces to said proppant, and wherein said system is configured such that said first fluid contains said first proppant at a concentration not to exceed the amount required to create a rarefied monolayer between said first inner surface and said second inner surface;

(iii) further reduce the pressure of said first fluid in said formation at a secondary fracturing rate greater than said trapping rate such that said first proppant creates orthogonal fractures in said first and second inner surfaces as said first and second inner surfaces fracture around said proppant; and (iv) pump said second fluid containing said second proppant into said fractured formation such that said orthogonal fractures open aid proppant is introduced into said orthogonal fractures.

13. The system of claim 12 wherein said first fluid comprises at least one of nitrogen or carbon dioxide.

14. The system of claim 12 wherein the ratio of said first proppant to said first fluid delivered to said fractured formation by said pump is lower than the ratio of said second proppant to said second fluid delivered to said fractured formation by said pumping device.

15. The system of claim 12 wherein size of said first proppant is in the range of from 4 mesh to 60 mesh and size of said second proppant is in the range of from 200 to 10 mesh.

* * * * *